US008579210B2

(12) United States Patent
Huang

(10) Patent No.: US 8,579,210 B2
(45) Date of Patent: Nov. 12, 2013

(54) SPRINKLER WITH ADJUSTABLE WATER OUTFLOW

(76) Inventor: Tzu-Lin Huang, Xianxi Township, Changhua County (TW)

( * ) Notice: Subject to any disclaimer, the term of this patent is extended or adjusted under 35 U.S.C. 154(b) by 249 days.

(21) Appl. No.: 13/290,539

(22) Filed: Nov. 7, 2011

(65) Prior Publication Data

US 2013/0112775 A1 May 9, 2013

(51) Int. Cl.
*B05B 3/02* (2006.01)
*B05B 3/08* (2006.01)
*B05B 3/14* (2006.01)

(52) U.S. Cl.
USPC ..... 239/394; 239/230; 239/392

(58) Field of Classification Search
USPC ..... 239/222.11, 222.13, 222.15, 222.17, 239/225.1, 230, 231, 390–394, DIG. 1
See application file for complete search history.

(56) References Cited

U.S. PATENT DOCUMENTS 7,458,527 B2 * 12/2008 Lutzki ..... 239/230
7,566,012 B2 * 7/2009 Wang et al. ..... 239/237
2010/0270398 A1 * 10/2010 Wang ..... 239/222.17

* cited by examiner

*Primary Examiner* — Darren W Gorman
(74) *Attorney, Agent, or Firm* — Egbert Law Offices, PLLC

(57) ABSTRACT

A ramming water sprinkler with changeable water outflow has a main body and a turning assembly configured on the top frame of the main body. The external circumference of the main body is covered by a water outlet adjustment revolving seat in a rotary state. Moreover, the revolving seat has a supporting end and a surrounding wall. The supporting end is seated on a preset position of the main body. A plurality of water outlet conduits with various calibers are configured and evenly distributed on the surrounding wall of the water outlet adjustment revolving seat. Each water outlet conduit defines a water inlet end and a water outlet end. The water inlet end of each can be rotated along with the turning of the water outlet adjustment revolving seat to be aligned with the water outlet of the main body for the purpose of adjusting the water outflow.

2 Claims, 4 Drawing Sheets

SPRINKLER WITH ADJUSTABLE WATER OUTFLOW

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a ramming water sprinkler, and more particularly to an innovative type of design with changeable water outflow.

2. Description of Related Art Including Information Disclosed Under 37 CFR 1.97 and 37 CFR 1.98.

The main structure of traditional gardening water sprinklers (generally referring to ramming water sprinklers with automatically turning water spray) is made up of a main body, a water inlet tube, a top frame, a turning assembly, and a water outlet conduit. The water outlet conduit is positioned on one side of the water sprinkler main body at a slightly upward oblique angle. When the water flow is guided in from the water inlet tube and sprinkled out from the water outlet conduit, the oblique design of the water outlet conduit will make the water spray to go in a parabolic path, and the accompanying turning assembly will generate an automatic turning spray for the purpose of irrigation.

However, in actual usage, it is found that the structural design of such prior-art ramming water sprinklers still has the following problems:

Due to the preset oblique angular configuration of the water outlet conduit, when using a traditional ramming water sprinkler for irrigation, when the water flow is sprayed out of the water outlet conduit, a spraying distance will be generated by the parabolic path, and the configuration of a turning assembly will cause circular or directional deflecting motion of the water spray. However, the water outlet ends of such traditional ramming water sprinklers are usually of a fixed caliber, and therefore the water outflow is uniform. This causes a problem of limited and inflexible water flow adjustment. To change the water outflow of the water sprinkler, the traditional way is to replace it with a ramming water sprinkler with different water outlet ends of a different caliber to generate expected water outflow. This means multiple models of ramming water sprinklers have to be produced, leading to considerable production costs. This is obviously a shortcoming.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The facts of efficacy enhancement of the present invention are as follows:

The "ramming water sprinkler" disclosed by the present invention mainly features an innovative and unique design of the water outlet adjustment revolving seat casing the external circumference of the main body. Compared to the known structures the prior art, the water outflow of the ramming water sprinkler can be adjusted by turning the water outlet adjustment revolving seat to adjust the alignment state between the water inlet end of the water outlet conduits and the water outlet of the main body. The usage is more convenient, and the adjustment function is more flexible and diversified, and therefore, the product can meet various application needs. Moreover, based on the structural design of the water outlet conduits with various calibers on the water outlet adjustment revolving seat, the water outflow of the ramming water sprinkler can be easily changed. In this way, the manufacturers and developers will be able to provide a product for multiple irrigation purposes and applicable in various environments at minimum production costs, and enhance the operational convenience of the ramming water sprinkler Hence, the present invention has practical improvements and good value for industrial utilization.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
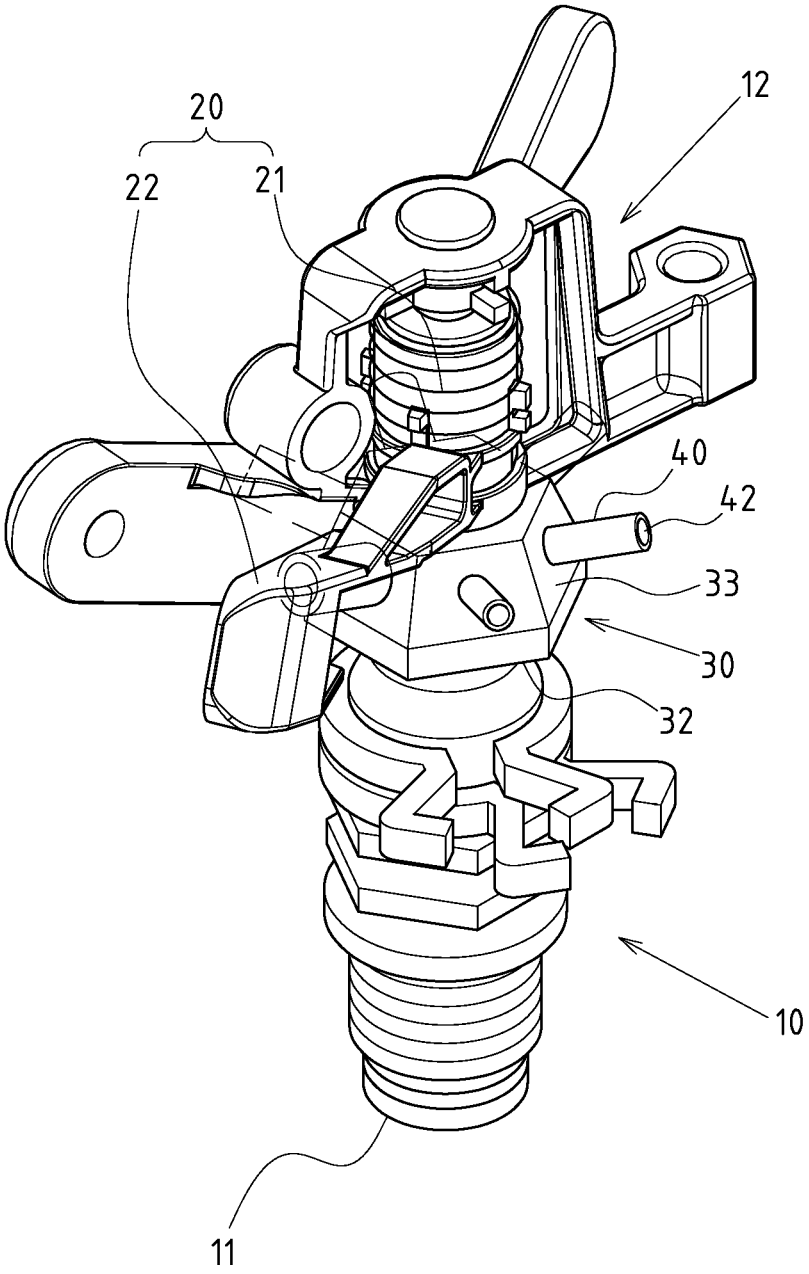
FIG. 1 is an assembled perspective view of a preferred embodiment of the present invention.
Figure 2:
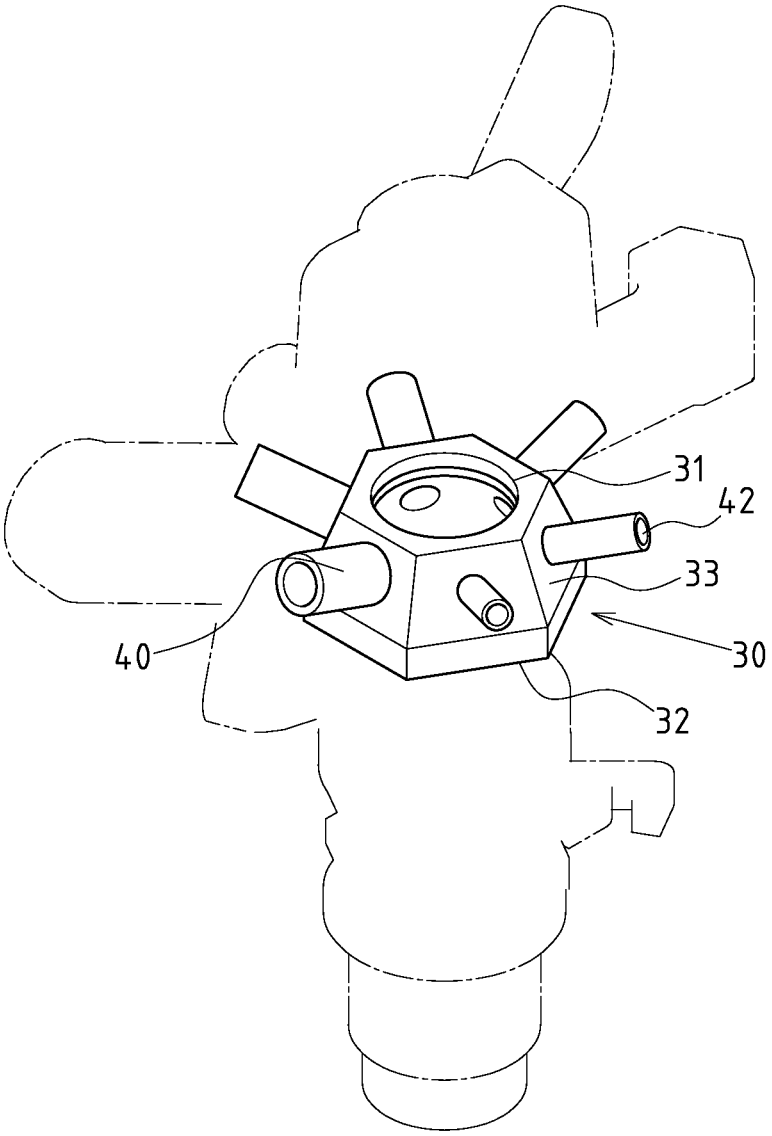
FIG. 2 is a perspective schematic view of the water outlet adjustment revolving seat of the present invention.

FIGS. 1, 2, 3 and 4 show the preferred embodiments of the ramming water sprinkler with changeable water outflow of the present invention. However, it is to be understood that, such an embodiment is illustrative only, and the structural disclosure is not intended to be limiting to the scope of patent application in any manner.

Said ramming water sprinkler comprises a main body 10, with its bottom configured with a water inlet tube connecting end 11, and its top configured with a top frame 12. Wherein, a water outlet 13 is configured at a position adjacent to the lower edge of the top frame 12 (only marked in FIG. 3).

A turning assembly 20 is mounted on the top frame 12 configured on top of the main body 10, including a torsion spring 21 and a turning piece 22. The turning piece 22 can be correspondingly placed on the spaced positions on the front ends of each water outlet conduit 40 of the below-described water outlet adjustment revolving seat 30.

Figure 4:
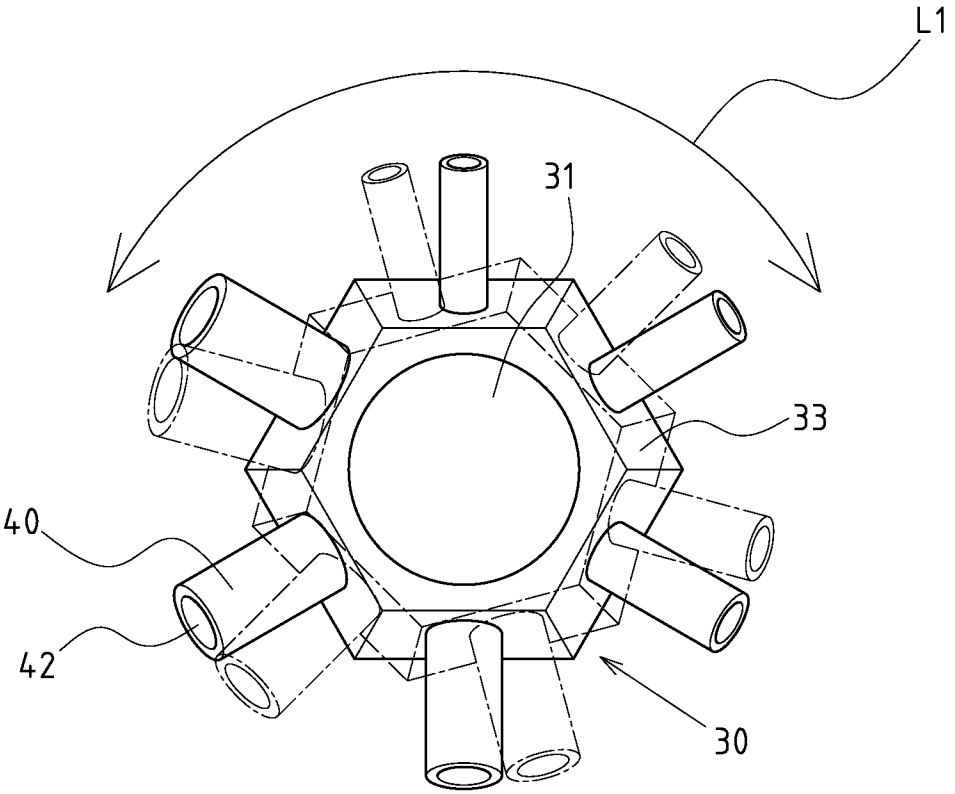
FIG. 4 is a schematic diagram illustrating the turning state of the water outlet adjustment revolving seat of the present invention.

A water outlet adjustment revolving seat 30 has a through axle bore 31 casing the external circumference of the main body 10, with the water outlet adjustment revolving seat 30 being in a rotary state (marked by Arrow L1 in FIG. 4). Moreover, the water outlet adjustment revolving seat 30 comprises a supporting end 32 and surrounding wall 33. The supporting end 32 is seated on a preset position of the main body 10.

A plurality of water outlet conduits 40 with various calibers are configured and evenly distributed on the surrounding wall 33 of the water outlet adjustment revolving seat 30. Each water outlet conduit 40 defines a water inlet end 41 and a water outlet end 42. The water inlet end 41 of each water outlet conduit 40 can be rotated along with the turning of the water outlet adjustment revolving seat 30 to be aligned with the water outlet 13 of the main body 10 for the purpose of adjusting the water outflow.

Wherein, a rubber 50 (marked in FIG. 3) is configured between the main body 10 and the through axle bore 31 of the water outlet adjustment revolving seat 30. With this structure, the water outlet adjustment revolving seat 30 has the function of adjustment and positioning.

Figure 3:
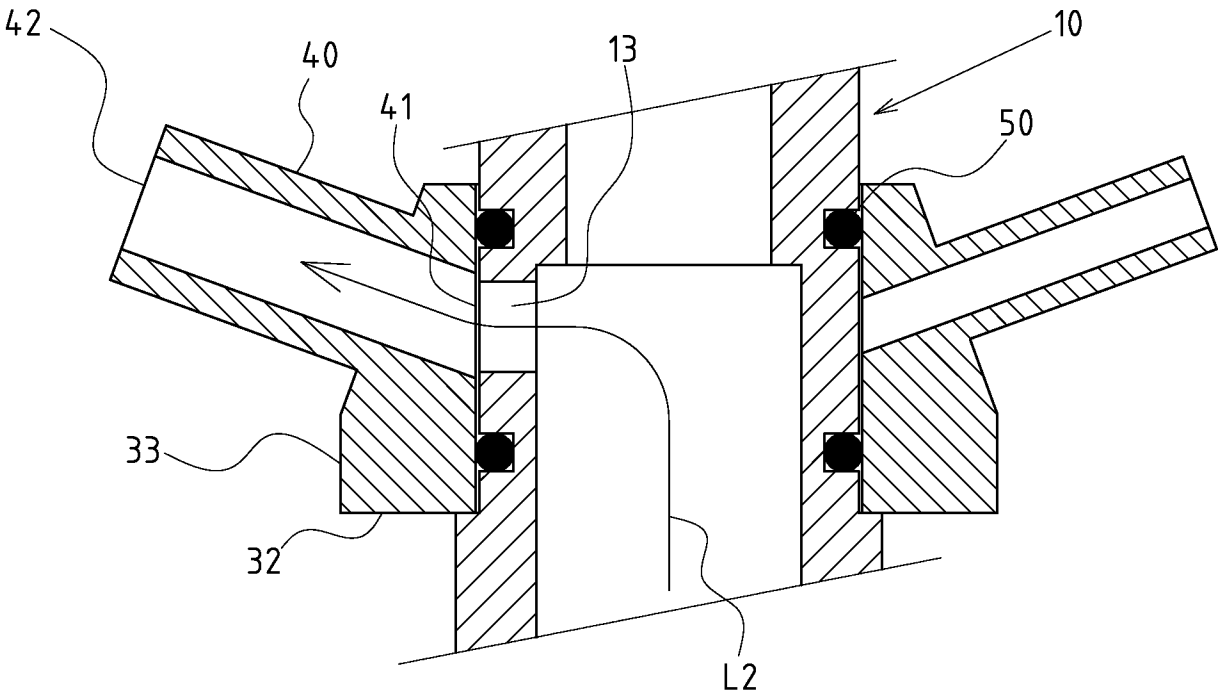
FIG. 3 is a plan sectional view of the water outlet adjustment revolving seat and main body of the present invention.

The above described structures constitute the design of the present invention. Below is a description of its working condition:

In using the ramming water sprinkler, by turning the water outlet adjustment revolving seat 30, the water inlet end 41 of the various water outlet conduits 40 can be adjusted to align with the water outlet 13 configured on the main body 10. FIG. 3 shows a state when the water inlet end 41 of the water outlet conduit 40 is aligned with the water outlet 13 of the main body. In this state, the water source will go from the water outlet 13 of the main body into the water inlet end 41 of the water outlet conduit 40, and be sprinkled from the water outlet end 42 of the water outlet conduit 40 (as marked by Arrow L2 in FIG. 3). In this way, based on the design with different calibers of the water outlet conduits 40, various water outflow modes can be adjusted to change the water outflow status and meet diversified irrigation needs.

I claim:

1. A ramming water sprinkler with changeable water outflow, which comprises:

a main body, with its bottom configured with a water inlet tube connecting end, and its top configured with a top frame, wherein, a water outlet is configured at a position adjacent to a lower edge of the top frame;

a turning assembly, mounted on the top frame configured on top of the main body, including a torsion spring and a turning piece;

a water outlet adjustment revolving seat, having a through axle bore casing an external circumference of the main body, with the water outlet adjustment revolving seat being in a rotary state and having a supporting end and a surrounding wall; the supporting end is seated on a preset position of the main body;

a plurality of water outlet conduits with various calibers, configured and evenly distributed on the surrounding wall of the water outlet adjustment revolving seat; each water outlet conduit defines a water inlet end and a water outlet end; the water inlet end of each water outlet conduit can be rotated along with the turning of the water outlet adjustment revolving seat to be aligned with the water outlet of the main body for the purpose of adjusting the water outflow.

2. The device defined in claim 1, wherein a rubber is configured between the main body and the through axle bore of the water outlet adjustment revolving seat.

* * * * *